US006458043B1

(12) United States Patent
McCabe et al.

(10) Patent No.: US 6,458,043 B1
(45) Date of Patent: Oct. 1, 2002

(54) GOLF CLUB HEAD WITH MULTI-RADIUS FACE

(75) Inventors: Terrill R. McCabe, Carlsbad, CA (US); Eddie G. Perez, Carlsbad, CA (US)

(73) Assignee: le;.5qAcushnet Company, Fairhaven, MA (US)

( * ) Notice: Subject to any disclaimer, the term of this patent is extended or adjusted under 35 U.S.C. 154(b) by 0 days.

(21) Appl. No.: 09/836,266

(22) Filed: Apr. 18, 2001

(51) Int. Cl.[7] ..... A63B 53/04
(52) U.S. Cl. ..... 473/330; 473/345; 473/346
(58) Field of Search ..... 473/330, 324, 473/345, 346, 329, 349, 350, 290, 288

(56) References Cited

U.S. PATENT DOCUMENTS

| | | | | |
|---|---|---|---|---|
| 1,299,014 | A | | 4/1919 | O'Hara |
| 1,525,137 | A | | 2/1925 | Lawton |
| 1,615,038 | A | | 1/1927 | Reuter, Jr. |
| 1,674,173 | A | | 6/1928 | Haupt |
| 2,023,885 | A | | 12/1935 | Hinckley |
| 2,087,685 | A | | 7/1937 | Hackney |
| 2,395,837 | A | | 3/1946 | Baymiller et al. |
| 3,172,667 | A | | 3/1965 | Baker et al. |
| 3,368,812 | A | * | 2/1968 | Baldwin |
| 3,625,518 | A | | 12/1971 | Solheim |
| 3,989,257 | A | | 11/1976 | Barr |
| 4,162,074 | A | | 7/1979 | Thomson |
| 4,367,878 | A | | 1/1983 | Schmidt |
| 4,471,961 | A | | 9/1984 | Masghati et al. |
| 4,508,349 | A | | 4/1985 | Gebauer et al. |
| 4,523,759 | A | | 6/1985 | Igarashi |
| 4,725,062 | A | | 2/1988 | Kinney, III |
| 5,098,103 | A | | 3/1992 | MacKeil |
| 5,141,231 | A | * | 8/1992 | Cox |
| 5,242,167 | A | | 9/1993 | Antonious |
| 5,333,862 | A | | 8/1994 | Teramoto et al. |
| 5,333,873 | A | | 8/1994 | Burke |
| 5,366,223 | A | | 11/1994 | Werner et al. |
| 5,377,986 | A | * | 1/1995 | Viollaz |
| 5,415,405 | A | | 5/1995 | Vincent |
| 5,497,993 | A | | 3/1996 | Shan |
| 5,527,034 | A | | 6/1996 | Ashcraft et al. |
| 5,595,552 | A | | 1/1997 | Wright et al. |
| D379,393 | S | | 5/1997 | Kubica et al. |
| 5,645,495 | A | | 7/1997 | Saso |
| 5,649,872 | A | | 7/1997 | Antonious |
| 5,681,228 | A | | 10/1997 | Mikame et al. |
| D387,113 | S | | 12/1997 | Burrows |
| 5,695,411 | A | | 12/1997 | Wright et al. |
| 5,718,641 | A | | 2/1998 | Lin |
| 5,776,011 | A | | 7/1998 | Su et al. |
| D401,652 | S | | 11/1998 | Burrows |
| 5,830,084 | A | | 11/1998 | Kosmatka |
| 5,851,159 | A | | 12/1998 | Burrows |
| D406,294 | S | | 3/1999 | Burrows |
| D411,272 | S | | 6/1999 | Burrows |
| 5,916,043 | A | | 6/1999 | Saso |
| 5,954,596 | A | | 9/1999 | Noble et al. |
| 6,093,115 | A | | 7/2000 | Murtland et al. |

FOREIGN PATENT DOCUMENTS

| | | | |
|---|---|---|---|
| JP | 9-154985 | | 6/1997 |
| JP | 9-168613 | * | 6/1997 |
| JP | 9-239074 | | 9/1997 |
| JP | 9-239075 | | 9/1997 |
| JP | 11-42301 | | 2/1999 |

* cited by examiner

*Primary Examiner*—Sebastiano Passaniti
(74) *Attorney, Agent, or Firm*—Swidler Berlin Shereff Friedman, LLP

(57) ABSTRACT

A metal wood golf club head adapted for attachment to a shaft is disclosed, including a shell defining a body and further including a face. The face of the club head has exterior and interior surfaces disposed such that the exterior surface has a vertical roll radius that is less than the vertical roll radius of the interior surface. The face may also have a horizontal bulge radius of the exterior surface that is less than the horizontal bulge radius of the interior surface. A central thickened region may be provided on the interior surface.

20 Claims, 2 Drawing Sheets

GOLF CLUB HEAD WITH MULTI-RADIUS FACE

FIELD OF THE INVENTION

The invention relates to a golf club head. More particularly, the invention relates to a golf club head with a face having different radii of curvature on interior and exterior surfaces.

BACKGROUND OF THE INVENTION

The design of club heads has long been studied. Among the more prominent considerations in club head design are loft, lie, face angle, horizontal face bulge, vertical face roll, face progression, sole curvature, center of gravity location, and overall head weight. Although all of these aspects may be considered in golf club engineering, several are often accorded more weight in the design process due to their significant impact on club performance.

Golf club heads must be strong enough to withstand the impact forces that occur during collision between the head and the ball. The loading that occurs during this event can cause an acceleration to the golf ball that is four orders of magnitude greater than that of gravity. Thus, the club face and body should be designed to resist permanent deformation or catastrophic failure, such as by material yield or fracture. Thus, for example, it is not unusual for club heads of prior art hollow metal woods, produced from titanium, to have a generally uniform face thickness exceeding 0.15 inches. This thickness has been required to ensure structural integrity of the club head during impact.

Players generally seek a golf club and golf ball combination that delivers maximum distance and landing accuracy. The distance a ball travels after impact is dictated by the magnitude and direction of the ball's translational velocity and the magnitude and direction of the ball's rotational velocity or spin. Environmental conditions, including atmospheric pressure, humidity, temperature, and wind speed further influence ball flight. However, these environmental effects are beyond the control of the golf equipment manufacturer. Golf ball landing accuracy is driven by a number of factors as well. Overall, among the factors that can be controlled during club head design, the center of gravity and club face flexibility can have a significant influence on the performance of the club head.

The United States Golf Association (USGA), the governing body for the rules of golf in the United States, has specifications for the performance of golf balls. These performance specifications dictate the size and weight of a golf ball that conforms to the USGA. Furthermore, there are USGA rules which limit the golf ball velocity after a prescribed impact. To achieve greater golf ball distance, ball velocity after impact must be maximized while remaining within USGA guidelines. This may be accomplished by allowing more club face deformation during impact. A variety of techniques may be utilized to vary the allowable deformation of the club face. For example, uniform face thinning, thinned faces with ribbed stiffeners, and a varied thickness on the face profile are three possibilities. Any design must have sufficient structural integrity to withstand impact without permanent deformation of the club face.

For example, U.S. Pat. No. 5,954,596 to Noble et al. discloses a golf club head with a reinforced front wall. The front wall of the body varies in thickness in two planes including a first plane that is disposed substantially horizontally between the top and bottom walls of the body and a second plane that is disposed substantially vertically between the heel and toe ends of the head. The body front wall has a bulge of increased thickness formed on the inner surface to increase thickness.

U.S. Pat. No. 5,830,084 to Kosmatka discloses a contoured golf club face that includes a vertical stiffening region and a horizontal stiffening region. This creates four similar contoured quadrants of increasingly thinning material toward the center of each quadrant, with thickening regions at face/sole and face/crown intersection regions. The thicknesses of adjoining regions are gradually blended to provide a smooth contoured surface.

Despite the several aforementioned club head designs, there remains a need for a wood-type golf club with a face that provides improved hitting performance through the structural design of the face. More particularly, there remains a need for a wood-type golf club head with a multi-radius face having different interior and exterior radii.

SUMMARY OF THE INVENTION

The present invention is related to a metal wood golf club head adapted for attachment to a shaft. The club head includes a body having a crown region, a sole region, a toe region, a heel region, and a ball-striking face extending therebetween. The face has an exterior surface substantially disposed at a first vertical roll radius and an interior surface substantially disposed at a second vertical roll radius. The first vertical roll radius is less than the second vertical roll radius. In one embodiment, the first vertical roll radius is between about 12 inches and about 18 inches, and the second vertical roll radius is between about 15 inches and about 50 inches. The second vertical roll radius may be at least about 1.2 times greater than the first vertical roll radius. In another embodiment, a portion of the inner surface is substantially planar.

The interior surface of the face may include a central thickened region having a ring portion and a plurality of branch portions radiating thereabout. The branch portions may be generally triangular.

In some embodiments, the exterior surface is further substantially disposed at a first horizontal bulge radius and the interior surface is further substantially disposed at a second horizontal bulge radius, with the first horizontal bulge radius being less than the second horizontal bulge radius. The first horizontal bulge radius may be between about 8 inches and about 12 inches, while the second horizontal bulge radius may be between about 15 inches and about 50 inches. The second horizontal bulge radius may be at least about 1.2 times greater than the first horizontal bulge radius, and a portion of the inner surface may be substantially planar. The central thickened region may include a plurality of branch portions radiating about a central point.

The present invention also is related to a metal wood golf club head adapted for attachment to a shaft, including a shell defining a body and further including a face. The face has an exterior surface and an interior surface, with the exterior surface being substantially defined along a first radius and the interior surface being substantially defined along a second radius, such that the first radius is less than the second radius. In some embodiments, the first radius and the second radius are vertical roll radii. The first radius may be between about 12 inches and about 18 inches, and the second radius may be at least about 15 inches. In addition, a central thickened region may be provided on the interior surface, and may have a ring portion with a plurality of branch portions radiating thereabout.

The present invention further is related to a face adapted for attachment to a body of a golf club head, consisting essentially of an exterior surface having a first vertical roll radius, an interior surface having a second vertical roll radius, wherein the first vertical roll radius is substantially less than the second vertical roll radius. The interior surface also may include a perimetral rim, and the exterior surface also may include a plurality of grooves. The first vertical roll radius may be between about 12 inches and about 18 inches, while the second vertical roll radius may be between about 15 inches and about 50 inches. The second vertical roll radius may be at least about 1.2 times greater than the first vertical roll radius, and a portion of the inner surface may be substantially planar.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE PREFERRED EMBODIMENTS

Figure 1:
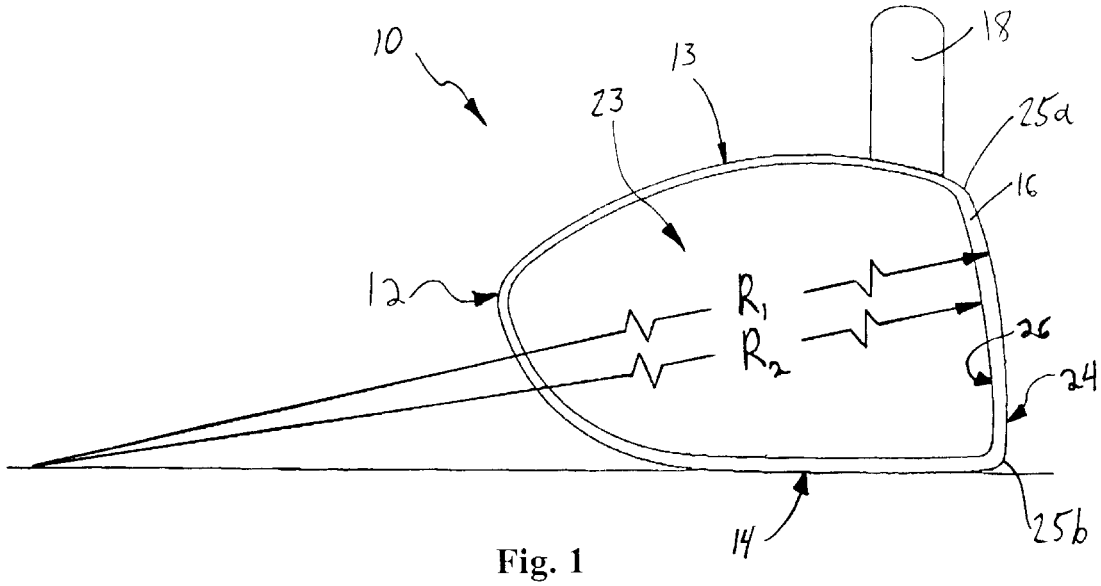
FIG. 1 is a partial cross-sectional side view of a golf club head with a face having different interior and external vertical roll radii in accordance with the present invention.

Referring to FIG. 1, golf club head 10 includes a body 12 with a crown region 13, a sole region 14, a face 16 for striking the golf ball, along with a hosel 18. Body 12 also has a heel region 21 and a toe region 22, and defines a shell with a cavity 23. Face 16 preferably has a loft angle of less than about 12 degrees, and more preferably has a loft angle between about 10 and 12 degrees. Face 16 also includes exterior surface 24 and interior surface 26. Although not shown in detail, club head 10 may include a crown plate and/or sole plate. Club head 10 preferably has a volume of at least about 250 cc, and more preferably greater than about 300 cc. In addition, club head 10 is preferably formed of metal such as titanium and alloys thereof, and may be formed from separate body and face portions that are integrated, such as by welding. If such a multi-piece head is used, preferably the face is forged or stamped, while the body is cast. Alternatively, the face and body may both be cast as a single unit, providing for separate crown and/or sole pieces, or the club head may be only formed from forged or stamped components. Grooves may also be provided on the face.

As shown in FIG. 1, golf club head 10 in accordance with the present invention includes a face 16 with an exterior surface 24 that has a radius of curvature, radius $R_1$, or vertical roll radius, measured along exterior surface 24 from the top 25*a* to the bottom 25*b* of face 16. Vertical face roll affects the trajectory of the ball off a golf club face. The vertical roll radius, $R_1$, preferably is between 12 and 18 inches. Face 16 also includes an interior surface 26 that has a vertical radius of curvature, radius $R_2$, similarly measured along interior surface 26 from the top 25*a* to bottom 25*b* of face 16.

In a preferred embodiment, the exterior vertical roll radius $R_1$ is less than the interior vertical roll radius $R_2$. Radius $R_1$ is preferably between about 12 inches and about 18 inches. Preferably, radius $R_2$ is at least about 15 inches. More preferably, radius $R_2$ is between about 15 inches and about 50 inches.

In one embodiment, face 16 is preferably configured such that radius $R_2$ is at least about 1.2 times radius $R_1$.

In an alternate embodiment, a portion of interior surface 26 may be substantially flat.

Figure 2:
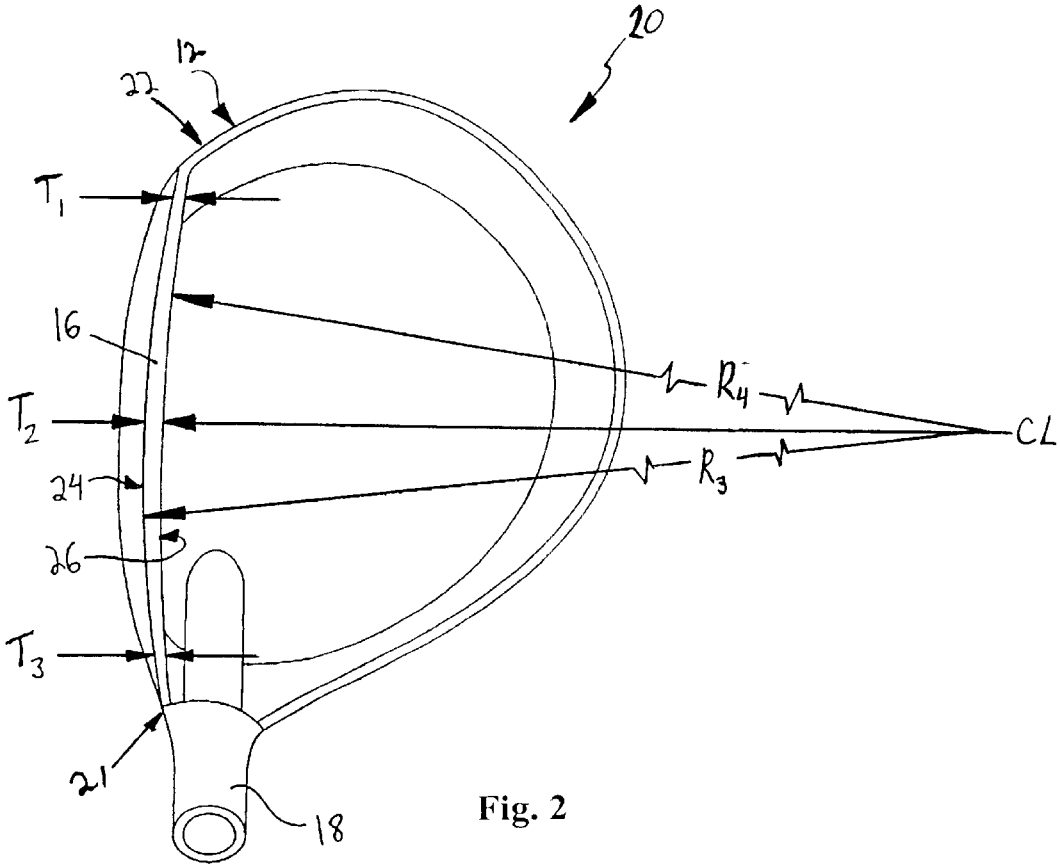
FIG. 2 shows a partial cross-sectional top view of a golf club head with a face having different interior and external horizontal bulge radii in accordance with the present invention.

Turning to FIG. 2, a golf club head 20 in accordance with the present invention includes a face 16 with an exterior surface 24 that has a radius of curvature, radius $R_3$, or horizontal bulge radius, measured from heel region 21 to toe region 22 along the horizontal midline adjacent exterior surface 24 that is preferably centered between the bottom and top of face 16. Horizontal face bulge compensates for a golfer's hitting of the ball off of the centerline of the face. If a ball is hit at an off-center location, the bulge effectively compensates for such misalignment that would otherwise cause hooking or slicing. Preferably, face 16 has a bulge radius $R_3$ of between 8 and 16 inches. Interior surface 26 of face 16 also includes a horizontal bulge radius of curvature, radius $R_4$, measured from heel region 21 to toe region 22 along the horizontal midline adjacent interior surface 26 that is preferably centered between the top 25*a* and bottom 25*b* of face 16.

In this embodiment, the exterior horizontal bulge radius $R_3$ is less than the interior horizontal bulge radius $R_4$. Radius $R_3$ is preferably between about 8 inches and about 12 inches. Preferably, radius $R_4$ is between about 15 inches and about 50 inches. Face 16 may be configured such that radius $R_4$ is at least about 1.2 times the radius $R_3$.

In an alternate embodiment, a portion of interior surface 26 may be substantially flat.

In addition, face 16 may also be configured such that the thickness $T_1$ near toe 22 is less than the thickness $T_2$ of face 16 measured at about the center line CL. Similarly, face 16 may be configured such that the thickness $T_3$ near heel region 21 is less than thickness $T_2$. In the preferred embodiment, thicknesses $T_1$, $T_3$ are about the same.

In an alternate embodiment of the present invention, the differing radii from the embodiments described with respect to FIGS. 1 and 2 may be combined. Thus, the vertical roll radius of exterior surface 24 of face 16 is less than the vertical roll radius of interior surface 26 of face 16, such as described above with respect to FIG. 1. Additionally, the horizontal bulge radius of exterior surface 24 of face 16 is less than the horizontal bulge radius of interior surface 26 of face 16, such as described above with respect to FIG. 2. Preferably, in this embodiment, exterior surface 24 is substantially convex, while interior surface 26 is substantially concave. Alternatively, exterior surface 24 may be substantially convex, while a portion of the interior surface 26 is substantially planar.

Advantageously, a golf club head including a multi-radius face 16 configured in accordance with one of the aforementioned embodiments may confer improved structural integrity to the club head, such that face 16 can withstand repeated impact with a golf ball without permanent deformation.

Figure 3:
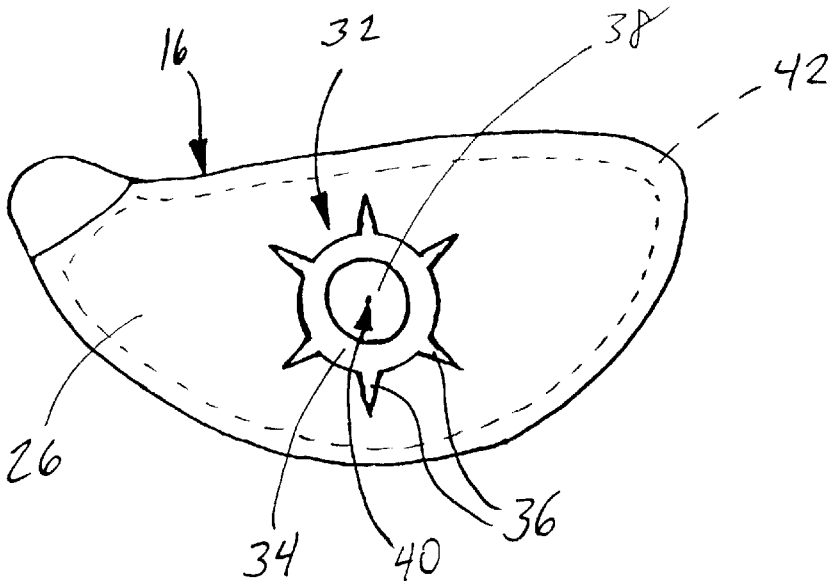
FIG. 3 shows a back view of the face of a golf club head in accordance with the present invention with a star-shaped thickened region.

In some embodiments of the present invention, face 26 is provided with a central thickened portion on interior surface 26. Preferably, as shown in FIG. 3, a star-shaped thickened region 32 protrudes from interior surface 26, and includes a ring portion 34 disposed about a central point 40 on face 26, and a plurality of spaced, branch portions 36 radiating from ring portion 34. While the thickened region 32 shown in FIG. 3 is generally star-shaped with six radiating portions 36, alternate embodiments may have fewer or more radiating portions. In addition, while radiating portions 36 are shown in generally triangular shape, other shapes are contemplated such as rectangular or arcuate. Also, while ring portion 34 forms a central depressed region 38 with a thickness less than the thickness of portions 34, 36, in alternate embodiments region 38 may have the same thickness or greater thickness than portions 34, 36. Furthermore, other geometric shapes may be chosen for thickened region 32. For example, although ring portion 34 is shown as being generally circular, non-circular rings such as elliptical, parabolic, or other arcuate shapes may be used. Advantageously, a central thickened region may provide improved structural integrity to a golf club head, and in particular improved stress management during impact of a golf ball with exterior surface 24 of face 16.

In some embodiments, a face 16 may be provided separately and welded to the body 12, crown and sole regions 13, 14, respectively to form a club head. Face 16 may include a protruding perimetral rim 42 on interior surface 26, as shown in phantom in FIG. 3 to denote this optional feature. Rim 42 facilitates attachment of face 16 to a club head.

Figure 4:
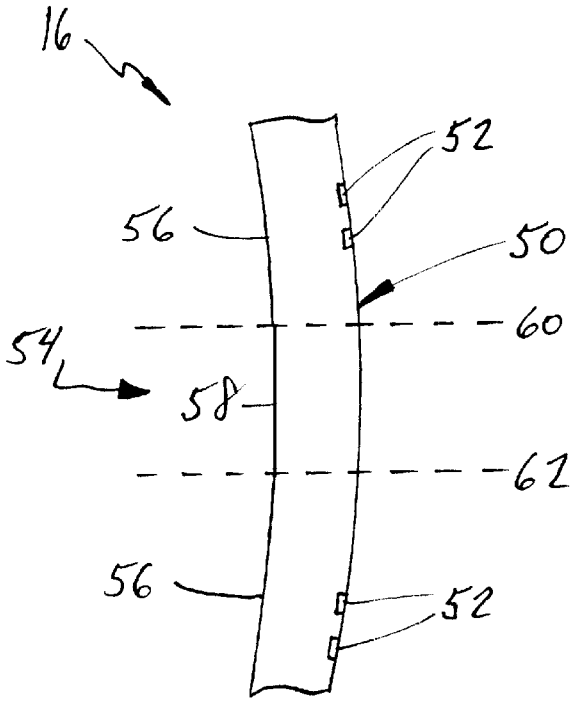
FIG. 4 shows a partial cross-sectional side view of a face of a golf club head in accordance with the present invention with an inner surface portion that is substantially planar.

Turning to FIG. 4, a partial cross-section is shown of one embodiment of a face 16 with an exterior surface 50 having grooving 52, and an interior surface 54. Exterior surface 50 has a vertical roll radius that is less than the vertical roll radius of interior surface portion 56. Face 16 also is provided with an interior surface portion 58 that is substantially flat. Although flat interior surface portion 58 is shown in a central location on face 16, it instead may be provided elsewhere on interior surface 54. In one embodiment, flat interior surface portion 58 has a thickness between about 0.12 inch and about 0.13 inch, while interior surface portion 56 has a thickness between about 0.11 inch and about 0.12 inch.

While various descriptions of the present invention are described above, it should be understood that the various features of each embodiment can be used singly or in any combination thereof. Therefore, this invention is not to be limited to only the specifically preferred embodiments depicted herein. Further, it should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A metal wood golf club head adapted for attachment to a shaft comprising:

a body having a crown region, a sole region, a toe region, a heel region, and a ball-striking face extending therebetween, the face comprising an exterior surface substantially disposed at a first vertical roll radius and an interior surface substantially disposed at a second vertical roll radius, wherein the first vertical roll radius is less than the second vertical roll radius, the first vertical roll radius is between about 12 inches and about 18 inches, and the second vertical roll radius is between about 15 inches and about 50 inches.

2. The golf club head of claim 1, wherein the second vertical roll radius is at least about 1.2 times greater than the first vertical roll radius.

3. The golf club head of claim 1, wherein a portion of the inner surface is substantially planar.

4. The golf club head of claim 1, wherein the interior surface further comprises a central thickened region.

5. The golf club head of claim 4, wherein the central thickened region comprises a ring portion and a plurality of branch portions radiating thereabout.

6. The golf club head of claim 5, wherein the branch portions are generally triangular.

7. The golf club head of claim 4, wherein the central thickened region comprises a plurality of branch portions about a central point.

8. The golf club head of claim 1, wherein the exterior surface is further substantially disposed at a first horizontal bulge radius and the interior surface is further substantially disposed at a second horizontal bulge radius, wherein the first horizontal bulge radius is less than the second horizontal bulge radius.

9. The golf club head of claim 8, wherein the first horizontal bulge radius is between about 8 inches and about 12 inches.

10. The golf club head of claim 9, wherein the second horizontal bulge radius is between about 15 inches and about 50 inches.

11. The golf club head of claim 9, wherein the second horizontal bulge radius is at least about 1.2 times greater than the first horizontal bulge radius.

12. The golf club head of claim 8, wherein a portion of the inner surface is substantially planar.

13. A metal wood golf club adapted for attachment to a shaft comprising:

a shell defining a body and further including a face, the face having an exterior surface and an interior surface, wherein said exterior surface is substantially defined along a first radius and said interior surface is substantially defined along a second radius, said first radius being less than said second radius, the first radius is between about 12 inches and about 18 inches, and the second radius is between about 15 inches and about 50 inches.

14. The golf club head of claim 13, wherein said first radius and said second radius are vertical roll radii.

15. The golf club head of claim 14, wherein said interior surface further comprises a central thickened region having a ring portion and a plurality of branch portions radiating thereabout.

16. A face adapted for attachment to a body of a golf club head, consisting essentially of:

an exterior surface having a first vertical roll radius;

an interior surface having a second vertical roll radius;

wherein the first vertical roll radius is substantially less than the second vertical roll radius, the first vertical roll radius is between about 12 inches and about 18 inches and the second vertical roll radius is between about 15 inches and about 50 inches.

17. The face of claim 16, wherein the interior surface further comprises a perimetral rim.

18. The golf club head of claim 17, wherein the second vertical roll radius is at least about 1.2 times greater than the first vertical roll radius.

19. The golf club head of claim 16, wherein a portion of the inner surface is substantially planar.

20. The golf club head of claim 16, wherein the exterior surface further comprises a plurality of grooves.

* * * * *

UNITED STATES PATENT AND TRADEMARK OFFICE

CERTIFICATE OF CORRECTION

PATENT NO. : 6,458,043 B1 
DATED : October 1, 2002
INVENTOR(S) : Terrill R. McCabe and Eddie G. Perez It is certified that error appears in the above-identified patent and that said Letters Patent is hereby corrected as shown below:

Title page,
Item [73], Assignee, the spelling of the Assignee name should be changed from "le;.5qAcushnet Company" to -- Acushnet Company. --

Signed and Sealed this

Eleventh Day of February, 2003

JAMES E. ROGAN
*Director of the United States Patent and Trademark Office*